United States Patent [19]

Osborn, III

[11] 4,447,294

[45] May 8, 1984

[54] PROCESS FOR MAKING ABSORBENT TISSUE PAPER WITH HIGH WET STRENGTH AND LOW DRY STRENGTH

[75] Inventor: Thomas W. Osborn, III, Cincinnati, Ohio

[73] Assignee: The Procter & Gamble Company, Cincinnati, Ohio

[21] Appl. No.: 335,497

[22] Filed: Dec. 30, 1981

[51] Int. Cl.[3] ..... D21H 3/02

[52] U.S. Cl. ..... 162/158; 162/112; 162/135; 162/185

[58] Field of Search ..... 162/111, 112, 158, 183, 162/184, 185, 135; 427/326, 395

[56] References Cited

U.S. PATENT DOCUMENTS

| | | | |
|---|---|---|---|
| 2,683,087 | 7/1954 | Reynolds | 162/158 |
| 2,778,749 | 1/1957 | Bainbridge et al. | 162/158 |
| 2,877,115 | 3/1959 | Wemyss et al. | 162/185 |
| 2,944,931 | 7/1960 | Yang | 162/185 |
| 3,442,692 | 5/1969 | Gaiser | 427/240 |
| 3,554,863 | 1/1971 | Hervey et al. | 162/158 |
| 3,755,220 | 8/1973 | Freimark et al. | 162/166 |
| 3,821,068 | 6/1974 | Shaw | 162/111 |
| 4,144,122 | 3/1979 | Emanuelsson et al. | 162/158 |
| 4,149,551 | 4/1979 | Benjamin et al. | 132/7 |

FOREIGN PATENT DOCUMENTS 677257 12/1967 South Africa .

OTHER PUBLICATIONS

"Applications of Armak Quaternary Ammonium Salts", Bulletin 76-17, Armak Co., (1977).

*Primary Examiner*—Peter Chin

*Attorney, Agent, or Firm*—Monte D. Witte; Fredrick H. Braun; Richard C. Witte

[57] ABSTRACT

A process for making soft, absorbent tissue paper webs and the webs made by that process. In the first step, a furnish of papermaking fibers and a wet strength resin is provided. A wet fibrous web is made from the furnish and the wet web is dried. Next, the wet strength resin in the web is at least partially cured. A nitrogenous cationic debonding agent is then incorporated into the dried web.

8 Claims, No Drawings

PROCESS FOR MAKING ABSORBENT TISSUE PAPER WITH HIGH WET STRENGTH AND LOW DRY STRENGTH

BACKGROUND OF THE INVENTION

1. Field of the Invention

This invention relates to tissue paper webs. More particularly, it relates to soft, absorbent tissue paper webs having relatively high wet tensile strength and reduced dry tensile strength and which can be used in toweling and facial tissue products.

2. Background Art

Paper webs or sheets, sometimes called tissue or paper tissue webs or sheets, find extensive use in modern society. Such items as paper towels and facial tissues are staple items of commerce. It has long been recognized that three important physical attibutes of these products are their softness; their absorbency, particularly their absorbency for aqueous systems; and their strength, particularly their strength when wet. Research and development efforts have been directed to the improvement of each of these attributes without deleteriously affecting the others as well as to the improvement of two or three attributes simultaneously.

Softness is the tactile sensation perceived by the consumer as he holds a particular product, rubs it across his skin, or crumples it within his hand. This tactile sensation is a combination of several physical properties. One of the more important physical properties related to softness is generally considered by those skilled in the art to be the stiffness of the paper web from which the product is made. Stiffness, in turn, is usually considered to be inversely dependent on the dry tensile strength of the web.

Strength is the ability of the product, and its constituent webs, to maintain physical integrity and to resist tearing, bursting, and shredding under use conditions, particularly when wet.

Absorbency is the measure of the ability of a product, and its constituent webs, to absorb quantities of liquid, particularly aqueous solutions or dispersions. Overall absorbency as perceived by the human consumer is generally considered to be a combination of the total quantity of liquid a given mass of tissue paper will absorb at saturation as well as the rate at which the mass absorbs the liquid.

The use of wet strength resins to enhance the strength of a paper web is widely known. For example, Westfelt described a number of such materials and discussed their chemistry in Cellulose Chemistry and Technology, Volume 13, at pages 813–825 (1979).

Freimark et al in U.S. Pat. No. 3,755,220 issued Aug. 28, 1973 mention that certain chemical additives known as debonding agents interfere with the natural fiber-to-fiber bonding that occurs during sheet formation in papermaking processes. This reduction in bonding leads to a softer, or less harsh, sheet of paper. Freimark et al go on to teach the use of wet strength resins to enhance the wet strength of the sheet in conjunction with the use of debonding agents to off-set undesirable effects of the wet strength resin. These debonding agents, which are added to the system ahead of the Fourdrinier wire or other sheet-forming stage, do reduce dry tensile strength, but there is also generally a reduction in wet tensile strength.

Shaw, in U.S. Pat. No. 3,821,068, issued June 28, 1974, also teaches that chemical debonders can be used to reduce the stiffness, and thus enhance the softness, of a tissue paper web.

Chemical debonding agents have been disclosed in various references such as U.S. Pat. No. 3,554,862, issued to Hervey et al. on Jan. 12, 1971. These materials include quaternary ammonium salts such as trimethylcocoammonium chloride, trimethyloleylammonium chloride, dimethyldi(hydrogenated-tallow)ammonium chloride and trimethylstearylammonium chloride.

Emanuelsson et al, in U.S. Pat. No. 4,144,122, issued Mar. 13, 1979, teach the use of complex quaternary ammonium compounds such as bis(alkoxy-(2-hydroxy)-propylene) quaternary ammonium chlorides to soften webs. These authors also attempt to overcome any decrease in absorbency caused by the debonders through the use of nonionic surfactants such as ethylene oxide and propylene oxide adducts of fatty alcohols.

Armak Company, of Chicago, Ill., in their bulletin 76-17 (1977) have taught that the use of dimethyldi(hydrogenated-tallow)ammonium chloride in combination with fatty acid esters of polyoxyethylene glycols may impart both softness and absorbency to tissue paper webs.

One exemplary result of research directed toward improved paper webs is described in U.S. Pat. No. 3,301,746 issued to Sanford and Sisson on Jan. 31, 1967. Despite the high quality of paper webs made by the process described in this patent, and despite the commercial success of products formed from these webs, research efforts directed to finding improved products have continued.

For example, Becker et al. in U.S. Pat. No. 4,158,594 issued Jan. 19, 1979 describe a method they contend will form a strong, soft, fibrous sheet. More specifically, they teach that the strength of a tissue paper web (which may have been softened by the addition of chemical debonding agents) can be enhanced by adhering, during processing, one surface of the web to a creping surface in a fine patterned arrangement by a bonding material (such as an acrylic latex rubber emulsion, a water soluble resin, or an elastomeric bonding material) which has been adhered to one surface of the web and to the creping surface in the fine patterned arrangement, and creping the web from the creping surface to form a sheet material.

DISCLOSURE OF THE INVENTION

Summary of the Invention

The present invention is a process for producing tissue paper webs having improved softness and absorbency and the webs so produced. The process comprises the steps of (a) providing an aqueous papermaking furnish comprising papermaking fibers and a wet strength resin; (b) preparing a wet fibrous web from the furnish; (c) drying the fibrous web so formed; (d) at least partially curing the wet strength resin in the dried web; and (e) incorporating into the web at least one cationic debonding agent. The webs comprise papermaking fibers, at least partially cured wet strength resin, and cationic debonding agent and are made by the process of this invention.

Accordingly, it is an object of this invention to provide a process for making soft, absorbent tissue paper webs.

It is a further object of this invention to provide soft, absorbent tissue paper webs.

It is a still further object of this invention to provide soft, absorbent paper towel products.

These and other objects will become readily apparent from a reading of the following Detailed Description of the Invention.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended examples.

As used herein, the terms "tissue paper web", "paper web", "web", and "paper sheet" all refer to sheets of paper made by a process comprising the steps of forming an aqueous papermaking furnish, depositing this furnish on a foraminous surface such as a Fourdrinier wire, and removing the water from the furnish as by gravity or vacuum-assisted drainage, with or without pressing, and by evaporation. The term "wet fibrous web" is used to refer to assemblages of fibers prepared as above, but before the assemblage has been dried; a "wet fibrous web" will ultimately become a "paper web", etc.

As used herein, an "aqueous papermaking furnish" is an aqueous slurry of papermaking fibers and the chemicals to be described hereinafter.

The first step in the process of this invention is providing an aqueous papermaking furnish. This furnish comprises papermaking fibers, (hereinafter sometimes referred to as wood pulp) and at least one wet strength resin as hereinafter described.

It is anticipated that wood pulp in all its varieties will normally comprise the papermaking fibers used in this invention. However, other cellulosic fibrous pulps, such as cotton liners, bagasse, rayon, etc., can be used and none are disclaimed. Wood pulps useful herein include both sulphite and sulfate pulps as well as mechanical and thermomechanical pulps all well known to those skilled in the art. Pulps derived from both desiduous and coniferous trees can be used. Preferably, the papermaking fibers used in this invention comprise Kraft pulp derived from northern softwoods.

Wet strength resins useful herein can be of several types. Generally, those resins which have previously found and which will hereafter find utility in the papermaking art are useful herein. Numerous examples are shown in the aforementioned paper by Westfelt, incorporated herein by reference.

In the usual case, the wet strength resins are water-soluble, cationic materials. That is to say, the resins are water-soluble at the time they are added to the papermaking furnish. It is quite possible, and even to be expected, that subsequent events such as cross-linking will render the resins insoluble in water. Further, some resins are soluble only under specific conditions, such as over a limited pH range.

Wet strength resins are generally believed to undergo a cross-linking or other curing reactions after they have been deposited on, within, or among the papermaking fibers. Cross-linking or curing does not normally occur so long as substantial amounts of water are present.

Of particular utility are the various polyamide-epichlorohydrin resins. These materials are low molecular weight polymers provided with reactive functional groups such as amino, epoxy, and azetidinium groups. The patent literature is replete with descriptions of processes for making such materials. U.S. Pat. No. 3,700,623 issued to Keim on Oct. 24, 1972 and U.S. Pat. No. 3,772,076 issued to Keim on Nov. 13, 1973 are examples of such patents and are incorporated herein by reference.

Polyamide-epichlorohydrin resins sold under the trademarks Kymeme 557H and Kymeme 2064 by Hercules Incorporated of Wilmington, Del., are particularly useful in this invention. These resins are generally described in the aforementioned patents to Keim.

Base-activated polyamide-epichlorohydrin resins useful in the present invention are sold under the Santo Res trademark, such as Santo Res 31, by Monsanto Company of St. Louis, Mo. These types of materials are generally described in U.S. Pat. Nos. 3,855,158 issued to Petrovich on Dec. 17, 1974; 3,899,388 issued to Petrovich on Aug. 12, 1975; 4,129,528 issued to Petrovich on Dec. 12, 1978; 4,147,586 issued to Petrovich on Apr. 3, 1979; and 4,222,921 issued to Van Eenam on Sept. 16, 1980, all incorporated herein by reference.

Other water-soluble cation resins useful herein are the polyacrylamide resins such as those sold under the Parez trademark, such as Parez 631NC, by American Cyanamid Company of Stanford, Conn. These materials are generally described in U.S. Pat. Nos. 3,556,932 issued to Coscia et al on Jan. 19, 1971; and 3,556,933 issued to Williams et al on Jan. 19, 1971, all incorporated herein by reference.

Still other water-soluble cationic resins finding utility in this invention are the urea formaldehyde and melamine formaldehyde resins. These polyfunctional, reactive polymers have molecular weights on the order of a few thousand. The more common functional groups include nitrogen containing groups such as amino groups and methylol groups attached to nitrogen.

Although less preferred, polyethylenimine type resins find utility in the present invention.

More complete descriptions of the aforementioned water-soluble cation resins, including their manufacture, can be found in TAPPI Monograph Series No. 29, *Wet Strength In Paper and Paperboard,* Technical Association of the Pulp and Paper Industry (New York; 1965), incorporated herein by reference.

Mixtures of compatible wet strength resins can be used in the practice of this invention.

The aqueous papermaking furnish can be prepared by any of the various methods using any of the common apparatus well known to those skilled in the art. Slurrying under conditions of agitation sufficient to essentially suspend the individual papermaking fibers and to uniformally distribute the wet strength resin throughout the papermaking furnish is usually adequate.

In addition to the papermaking fibers and the wet strength resin, the aqueous papermaking furnish can comprise additives commonly used in papermaking. Examples of such additives include dyes, pigments, and the like. Naturally, these optional additives must be selected so as not to interfere with the practice of this invention.

The second step in the process of this invention is the formation of a wet fibrous web from the papermaking furnish. Any of the methods used by those skilled in the papermaking art to prepare wet fibrous webs can be used herein. Typically, the papermaking furnish is deposited on a foraminous surface, such as a Fourdrinier wire, and water is removed from the furnish as by gravity or a vacuum assisted drainage, with or without pressing.

The third step of the process of this invention is the drying of the wet fibrous web to substantial dryness to form a sheet of paper. Any of the techniques well known to those skilled in the papermaking art for drying wet fibrous webs can be used. Typically, the web is dried by heat supplied by air moving around, over, or through the web; by contact with a heated surface; or by a combination of the two methods.

The fourth step in the process of the present invention is at least partially curing the wet strength resin in the web. Normally, the rate and extent of curing of the wet strength resin are dependent upon a complex time and temperature relationship characteristic of each particular wet strength resin. Normally, wet strength resins do not begin to cure until the fibrous webs containing them are substantially dry. (As used herein, substantially dry refers to fibrous webs containing not more than about 20% by weight, preferably not more than about 15%, moisture.) As can be appreciated by those skilled in the art, the exact point at which the wet strength resin begins to cure during the drying of the wet fibrous web is an indistinct one. The line of demarcation between the third and fourth steps of the process of this invention can, then, be indistinct. What is required in the present invention is that the fibrous web be substantially dried and that the wet strength bonds of whatever nature as provided by the wet strength resin begin to form. The extent of formation of these bonds must have proceeded to such an extent that subsequent process steps will not appreciably interfere with their ultimate completion and the corresponding wet strength development.

Those skilled in the art will recognize that the process of the present invention as described to this point is basically any of the papermaking processes which have found utility. Limitations such as the presence of wet strength resin in the aqueous papermaking furnish have been incorporated into the general papermaking processes.

Papermaking processes which have found utility in the practice in the present invention include that described in the aforementioned U.S. Pat. No. 3,301,746, incorporated herein by reference. Another is that which forms a patterned densified fibrous web having a relatively high bulk field of relatively low fiber density and a patterned array of spaced zones of relatively high fiber density wherein at least a substantial proportion of the relatively high density spaced zones are at least partially impregnated with binder material and in which the high bulk field is preferably substantially uncompacted and devoid of binder materials. This latter process is described in detail in European Patent Application No. 81200093.5 filed on behalf of the inventors P. G. Ayers and J. M. Raley on Jan. 26, 1981 and published Aug. 19, 1981, which application is incorporated herein by reference.

The fifth step in the process of this invention is incorporating into the web (which has been substantially dried and in which the wet strength resin has been at least partially cured) at least one nitrogenous cationic debonding agent (sometimes referred to hereinafter as "debonder").

Cationic debonding agents useful in the present invention include quaternary ammonium compounds.

Preferred quaternary ammonium compounds include those having the structure

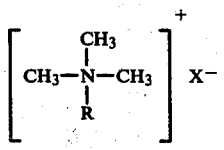

and those having the structure

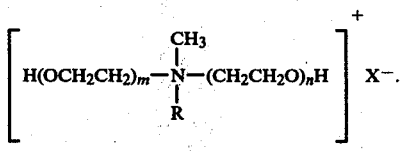

In the two structures noted above R is an aliphatic hydrocarbon radical preferably selected from the group consisting of alkyl having from about 12 to about 18 carbon atoms, alkylene having from about 12 to about 18 carbon atoms, coconut and tallow; m and n are both integers each having a value of at least 1; the sum of m and n preferably is from about 2 to about 15; and X is a halogen.

As used above, "coconut" refers to the alkyl and alkylene moieties derived from coconut oil. It is recognized that coconut oil is a naturally occuring mixture having, as do all naturally occuring materials, a range of compositions. Coconut oil contains primarily fatty acids (from which the alkyl and alkylene moieties of the quaternary ammonium salts are derived) having from 12 to 16 carbon atoms, although fatty acids having fewer and more carbon atoms are also present. Swern, Ed. in *Bailey's Industrial Oil And Fat Products,* Third Edition, John Wiley and Sons (New York; 1964) in Table 6.5, suggests that coconut oil typically has from about 65 to 82% by weight of its fatty acids in the 12 to 16 carbon atoms range with about 8% of the total fatty acid content being present as unsaturated molecules. The priniple unsaturated fatty acid in coconut oil is oleic acid. Synthetic as well as naturally occuring "coconut" mixtures fall within the scope of this invention.

Tallow, as is coconut, is a naturally occuring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention.

Alkylenes are generally preferred to alkyls. Coconut is more preferred than the alkyl and alkylene radicals noted above.

In the case of the methylpolyoxyethylene quaternary ammonium compounds, the sum of m and n is preferably about 2.

Any of the halide salts can be used in the present invention. Typically, and preferably, the chloride is used. Hereinafter quaternary ammonium compounds will frequently be referred to as chlorides for convenience even though the other halide salts are expressly not disclaimed.

Specific examples of quaternary ammonium salts useful in this invention include trimethyloctadecylammonium chloride, trimethylcocoammonium chloride, trimethyltallowammonium chloride, trimethylolelylammonium chloride, methylbis(2-hydroxyethyl)cocoammonium chloride, methylbis(2-hydroxyethyl)oleylammonium chloride, methylbis(2-hydroxyethyl)octadecylammonium chloride, methylbis(2-hydroxyethyl)tallowammonium chloride, methylpolyoxyethylene(15)cocoammonium chloride, and methylpolyoxyethylene(15)oleylammonium chloride.

These quaternary ammonium compounds can be prepared by any of the means well known to those skilled in the art.

The most preferred quaternary ammonium compound is methylbis(2-hydroxyethyl)cocoammonium chloride. This particular material is available commercially from Armak Company of Chicago, Ill. under the tradename "Ethoquad C/12".

Other cationic debonders useful herein are described in the aforementioned patent to Emanuelsson, incorporated herein by reference. These bis-(alkoxy-2(hydroxy)propylene quaternary ammonium compounds have the general formula

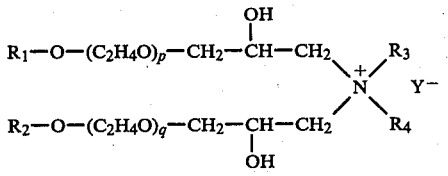

wherein $R_1$ and $R_2$ are aliphatic hydrocarbon groups, either saturated or unsaturated, having from about eight to about twenty-two carbon atoms; $R_3$ and $R_4$ are each selected from the group consisting of methyl, ethyl, and hydroxyethyl; p and q are integers each having a value of from about 2 to about 10; and $Y^-$ is a salt forming anion and can be either organic or inorganic. Materials such as these are sold under the tradename "Berocel" by Berol Chemie AB of Sweden.

Mixtures of compatible debonders can be used in the practice of this invention.

Optionally, nonionic surfactants can be incorporated into the dried web either before or after the debonders are incorporated therein or, preferably, simultaneously with such incorporation.

Nonionic surfactants optionally useful in the present invention include the ether and ester adducts of ethylene oxide and fatty chemicals. That is to say, the nonionic surfactants optionally useful herein can be described as the ethylene oxide adducts of, respectively, fatty alcohols and fatty acids. The fatty moiety of the nonionic surfactants preferably comprises from about 12 to about 18 carbon atoms. The ethylene oxide moiety of the nonionic surfactant preferably comprises from about 2 to about 12 moles ethylene oxide, most preferably from about 2 to about 9 moles of ethylene oxide. Preferably, the fatty moiety is unsaturated. Specific examples of nonionic surfactants useful in the present invention include polyoxyethylene(2)oleyl ether and polyoxyethylene(9)oleyl ester. The former is known in CFTA nomenclature as Oleth-2, the latter as PEG-9 oleate.

Diesters, such as PEG-4 dilaurate (one mole of lauric acid adducted with 4 moles of ethylene oxide), are also useful in the present invention.

These nonionic surfactants can be prepared by any of the means well known to those skilled in the art.

Debonders can be incorporated into the dried webs by any of the common techniques well known to those skilled in the art. One suitable and preferred technique is the spraying of the debonder onto the web. Depending upon the specific debonder used, it may be sprayed onto the dried web in its liquid (or molten) state or it may be sprayed onto the dried web either dissolved or dispersed in an inert carrier. Naturally, the specific inner carrier will depend upon the specific debonder used. As a practical matter, water is the preferred inert carrier for cost and process considerations. In certain circumstances, it may be desirable to apply such a large quantity of inert carrier to the dried web that a subsequent process operation to remove the inert carrier from the web (i.e., to redry the web) may be necessary. Any technique commonly used for drying paper webs can be used.

Alternatively, the debonder can be incorporated into the dried web by a padding technique. Here, the debonder is usually dispersed or dissolved in an inert carrier such as water and the dried web is passed through a bath of the dissolved or dispersed debonder. Subsequent drying operations are frequently required when a padding technique is used.

Another alternative method of incorporating the debonder into the dried web involves the use of transfer rolls to convey the debonder, usually dissolved or dispersed and an inert carrier, from a source of supply to the dried web in a manner analagous to printing.

In a still further alternative method of incorporation, the debonder, optionally dispersed are dissolved in an inert carrier, is extruded directly onto the dried web.

Following incorporation of the debonder into the dried web (and also following any optional post-debonder incorporation drying of the web) the soft, absorbent web of this invention is ready for use. Typically, the soft, absorbent web is reeled and stored prior to being converted into useful products such as paper towels.

The consistency of the papermaking fibers in the aqueous papermaking furnish can vary over the wide ranges commonly encountered in papermaking. Typically, the papermaking fibers comprise from about 0.25% to about 5% by weight of the aqueous papermaking furnish. The quantity of wet strength resin added to the papermaking furnish is, as in conventional papermaking, dependent upon the nature of the wet strength resin, the nature of the papermaking fibers, and the properties desired in the finished web. Typically, cationic wet strength resins of the types described above are present in the papermaking furnish at from about 0.25% to about 3% by weight (bone dry basis) of the papermaking fibers.

The amount of debonder incorporated into the dried web is dependent upon the nature of the debonder selected, the nature of the papermaking fibers comprising the web, the nature and level of the wet strength resin used in the web, and the properties desired in the finished web. Typically, the amount of debonder incorporated into the web is from about 0.1 to about 2.5% by weight of the papermaking fibers present in the web.

The soft, absorbent webs of this invention can be used in any application where such tissue paper webs are required. One particularly advantageous use is in paper towel products. For example, two soft, absorbent webs prepared by the process of this invention can be embossed and adhesively secured together in face-to-face relation as taught by U.S. Pat. No. 3,414,459, which issued to Wells on Dec. 3, 1968 and which is incorporated herein by reference, to form 2-ply paper towels.

In order to more fully describe the present invention, and not by way of limitation, the following examples are presented.

EXAMPLE I

Handsheets were made to demonstrate the present invention. The general method of preparation began with the formation of a 5% by weight aqueous slurry of papermaking fibers comprising 60% by weight northern softwood Kraft and 40% sulfite fibers. Kymene 557H wet strength resin was incorporated into the slurry at the level of 1% by weight of dry papermaking fibers. After agitation for about ten minutes at ambient temperature, the slurry was diluted with water to a fiber consistency of about 0.1% by weight. An aliquot of this thus formed furnish was further diluted by water in a deckle box and hand sheets were formed therefrom. These hand sheets were formed by draining the water from the furnish in the deckle box through a 100 mesh monel wire screen. The wet fibrous web thus formed was subjected to vacuum assisted drainage and was then transferred from the screen to a 36×30 mesh per 2.54 centimeter polyester fabric. The wet fibrous web was then dried with a drum dryer at 110° C. to form a sheet of paper.

The wet and dry tensile strength (in grams per 2.54 centimeters of sample) of each handsheet was determined by standard means using the Intelect 500 Tensile Tester made by Thwing-Albert Instrument Company, Philadelphia, Pa.

To measure absorbency, the VFS test was used. The amount of distilled water which would be absorbed and retained by a 27.9 centimeter square sample of the handsheet after emersion in distilled water and drainage in the horizontal position for two minutes followed by drainage in the vertical position for one minute was determined. Results were reported in grams of water per gram of sample.

The rate of absorbency of the handsheet was measured by the Sink test. In this test, eight plies of the handsheet, each 6.35×7.5 centimeters, were formed into a pad. The time required for the pad to be totally wet by distilled water contained within a vessel was determined. In this test, shorter times indicate more rapid absorbency.

The Reid test, in which the time in seconds required for 1/10 milliliter of distilled water to be absorbed by the handsheet, was also used to measure the rate of absorbency. As with the Sink test, shorter times indicate a greater rate of absorbency.

Basis weight was measured and reported as the weight of the handsheet in grams per square meter of handsheet.

Sample A was a control sample and received no treatment with chemicals beyond that described above.

Sample B was made according to the present invention. After the handsheet was dried as described above, and the wet strength resin had thus been allowed to at least partially cure, nitrogenous cationic debonder was incorporated into it by spraying. An aqueous suspension comprising 5% by weight Ethoquad C/12 and 5% by weight Oleth-2 was uniformly sprayed onto the handsheet until the level of cationic debonder was about 0.25% by weight. The resulting soft, absorbent web was allowed to stand overnight at 20° C. and 30% relative humidity before testing.

Sample C was an example of wet-end addition of cationic debonders. Here, sufficient Ethoquad C/12 and Oleth-2 were added to the aqueous slurry before the handsheet was made, each at a level of 0.25% by weight of papermaking fiber.

The results shown in the table clearly show the decreased dry tensile strength and enhanced absorbency with maintenance of wet tensile strength provided by this invention.

TABLE

| | Sample A | Sample B | Sample C |
|---|---|---|---|
| Dry Tensile | 715 | 637 | 363 |
| Wet Tensile | 154 | 146 | 90 |
| Sink | 3 | 1 | 1 |
| Reid | 20 | 9 | 19 |
| VFS | 6.1 | 6.5 | 6.4 |
| Basis Weight | 27.0 | 27.5 | 27.2 |

EXAMPLE II

A 5% by weight aqueous slurry of unbeaten northern softwood Kraft wood pulp fibers is formed in a conventional repulper. Kymene 557H polyamide-epichlorohydrin wet strength resin is added to the aqueous slurry through an inline mixer at a rate of 10 grams of wet strength resin per kilogram of bone dry papermaking fiber. The aqueous papermaking furnish thus formed is then provided to a papermaking machine as the practice of the first step of the process of this invention.

A wet fibrous web is formed from the papermaking furnish in the practice of the second step of the process of this invention. More specifically, the papermaking furnish is diluted with water to form a slurry containing approximately 0.12% by weight fiber. This slurry is then deposited on a Fourdrinier wire of 4-shed satin weave having about 31×24 machine direction (MD) by cross-machine direction (CD) filament mesh count per centimeter to form an embryonic web. Water is progressively removed as the embryonic web is carried through the papermaking machine first on the hereinbefore described Fourdrinier wire and after the embryonic web is transferred to an imprinting fabric which has a 5-shed satin weave 14×13, MD×CD, mesh count per centimeter such as described in U.S. Pat. No. 4,191,609, issued to Paul D. Trokhan on Mar. 4, 1980, incorporated herein by reference. Dewatering is accomplished by vacuum assisted drainage until the embryonic web has a fiber consistency of about 32%. As a result of the transfer from the Fourdrinier wire to the imprinting fabric and the vacuum assisted dewatering, the embryonic web becomes patterned densified when the resulting discrete spaced high density zones are juxtaposed the top surface plane knuckles of the imprinting fabric. Vacuum induced differential fluid pressure causes the unsupported portions of the embryonic web to be displaced into the interfilamentary voids of the imprinting fabric forming relatively low density spans between the knuckles. The resulting patterned densified embryonic web is predried by air blowthrough to an average fiber consistency of about 65% by weight.

The embryonic web, still disposed on the imprinting fabric, is carried forward through a full field pattern pressure biased imprinting device in such a manner that the relatively high density zones are pressed against the gravure cylinder and thereby impregnated with binder material. The relatively low density span zones are not so impregnated. The binder material is an acrylic emulsion polymer containing anionic functional groups in the polymer structure sold under the tradename Rolplex TR520 by Rohm & Haas Company of Philadelphia, Pa. In addition to the latex, the binder material contains about 1% ethylene oxide-based nonionic surfactant sold under the tradename Pluronic L92 by BASF Wyandotte Corporation of Parsippany, N.J., about 0.5% by weight ammonium nitrate; trace levels of commercial defoamers Foammaster 160-L as made by the Diamond Shamrock Company of Cleveland, Ohio and Colloid 694 as made Colloids, Inc. of Newark, N.J.; and ammonium hydroxide to adjust the pH to 5.0±0.5. Binder material is impregnated into the web at a level of approximately 5% by weight of fiber. Following impregnation, the web is adhered to the surface of a Yankee dryer with Gelvatol 20-90, a polyvinyl alcohol-acetate creping adhesive manufactured by Monsanto Company of St. Louis, Mo.

In the practice of the third step of the present invention, the wet fibrous web thus formed is dried on the surface of the Yankee dryer.

In the practice of the fourth step of the process of this invention, the Kymeme wet strength resin is subjected to an elevated temperature on the surface of the Yankee dryer and is partially cured.

In the practice of the fifth step of the process invention, 0.5% by weight Berocel 584 debonder is extruded onto the surface of the dried web immediately after the web is creped from the surface of the Yankee dryer. The resulting soft, absorbent tissue paper web is formed into rolls by reeling at 80% of the Yankee speed.

Two plies of the web are formed into paper towels by laminating them together using polyvinyl alcohol as the adhesive and the technique described in the hereinbefore incorporated U.S. Pat. No. 3,414,459. After storage for approximately six days at ambient temperatures, the resulting paper towels are found to be soft, absorbent, and sufficiently strong for practical use.

What is claimed is:

1. A process for making soft, absorbent tissue paper webs comprising the steps of:

(a) providing a papermaking furnish comprising papermaking fibers and from about 0.25% to about 3% by weight of said fibers of at least one wet strength resin;

(b) forming a wet fibrous web from said papermaking furnish;

(c) drying said web until said web contains not more than about 20% by weight moisture;

(d) at least partially curing said wet strength resin in said web; and (e) incorporating into said web from about 0.1% to about 2.5% by weight of said fibers of at least one cationic, nitrogenous debonding agent.

2. The process of claim 1 wherein said wet strength resin is a water-soluble, cationic resin.

3. The process of claims 1 or 2 wherein said debonding agent is a quaternary ammonium compound selected from the group consisting of (a) quaternary ammonium compounds having the structure

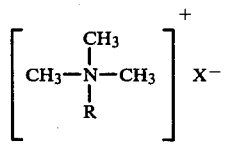

and (b) quaternary ammonium compounds having the structure

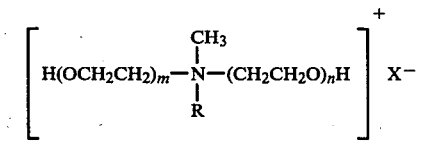

wherein R is an aliphatic hydrocarbon radical selected from the group consisting of alkyl radicals having from about 12 to about 18 carbon atoms, alkylene radicals having from about 12 to about 18 carbon atoms, coconut, and tallow, X is halogen, m and n are both integers each having a value of at least 1, and the sum of m and n is from about 2 to about 15.

4. The process of claims 1 or 2 wherein said debonding agent is a bis(alkoxy-2-(hydroxy)propylene quaternary ammonium compound having the structure

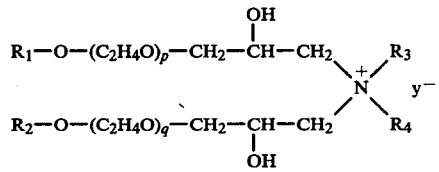

wherein $R_1$ and $R_2$ are each selected from the group consisting of saturated aliphatic groups having from about eight to about twenty-two carbon atoms and unsaturated aliphatic groups having from about eight to about twenty-two carbon atoms; $R_3$ and $R_4$ are each selected from the group consisting of methyl, ethyl, and hydroxyethyl; p and q are integers each having a value of from about 2 to about 10; and $Y^-$ is a salt forming anion.

5. The soft, absorbent tissue paper web made by the process of claim 1.

6. The soft, absorbent tissue paper web made by the process of claim 2.

7. The soft, absorbent tissue paper web made by the process of claim 3.

8. The soft, absorbent tissue paper web made by the process of claim 4.

* * * * *